United States Patent [19]

Johnson

[11] 4,196,000

[45] Apr. 1, 1980

[54] PHOTOGRAPHIC FILM UNIT

[75] Inventor: William H. Johnson, Pittsford, N.Y.

[73] Assignee: Eastman Kodak Company, Rochester, N.Y.

[21] Appl. No.: 938,614

[22] Filed: Aug. 31, 1978

Related U.S. Application Data

[63] Continuation of Ser. No. 834,590, Sep. 19, 1977, abandoned.

[51] Int. Cl.[2] ..... G03C 1/48; G03D 9/02

[52] U.S. Cl. ..... 430/207; 354/304

[58] Field of Search ..... 96/76 R, 67, 76 C; 354/304

[56] References Cited

U.S. PATENT DOCUMENTS

| | | | |
|---|---|---|---|
| 3,270,653 | 9/1966 | Bachelder | 96/76 R |
| 3,854,812 | 12/1974 | Sorli | 354/312 |
| 4,042,395 | 8/1977 | Tone et al. | 96/76 C |

*Primary Examiner*—Richard L. Schilling
*Attorney, Agent, or Firm*—J. A. Matthews

[57] ABSTRACT

A preregistered instant-processing film unit including an internal dark slide and adapted for use in exposure apparatus having processing rollers. The film unit includes a leader that carries "saddle detents" or detent shims located on opposite sides of the dark slide and having a caliper greater than the thickness of the dark slide. The shims are positioned to receive the rollers, both to provide sufficient clearance for removal of the dark slide therebetween and to hold the rest of the film unit in position while the dark slide is removed.

2 Claims, 12 Drawing Figures

PHOTOGRAPHIC FILM UNIT

CROSS-REFERENCE TO RELATED APPLICATIONS

This is a continuation of application Ser. No. 834,590 filed Sept. 19, 1977, now abandoned.

Reference is made to commonly assigned, copending U.S. patent applications Ser. No. 834,589 entitled INSTANT PROCESSING FILM UNIT HAVING INTERNAL DARK SLIDE filed in the name of Wayne A. Bubb; Ser. No. 834,588 entitled INSTANT PROCESSING FILM UNIT WITH INTERNAL DARK SLIDE AND LIGHT SEAL filed in the names of Charles J. Simpson and Richard H. Martens; and Ser. No. 834,617 entitled INSTANT PROCESSING FILM UNIT filed in the name of Robert A. Sylvester, all filed on even date herewith.

BACKGROUND OF THE INVENTION

The present invention relates to instant-processing film units suitable for daylight handling both before and after exposure. More specifically, the invention relates to such film units having an internal dark slide which is removeable from one end of the unit, and to means for facilitating the removal of the dark slide while holding the film unit in position in appropriate exposure and processing apparatus.

In cross-referenced U.S. patent application Ser. No. 834,589, entitled INSTANT-PROCESSING FILM UNIT HAVING INTERNAL DARK SLIDE, a film unit is disclosed which is suitable for daylight handling on a one-shot or single film unit basis both before and after exposure in commercially available apparatus. The film unit includes a photosensitive element for recording a latent image, a cover sheet preregistered with the element for facilitating the distribution of a processing composition over the element, and an internal dark slide removeably positioned between the element and sheet for shielding the photosensitive element from premature exposure or fogging. In operation, the film unit is daylight loaded into the exposure apparatus and then the dark slide is removed so the film unit can be exposed in the usual manner.

Film units of the abovementioned type offer significant advantages over previously available approaches. They are suitable for pre-exposure as well as post-exposure daylight handling on an individual or one-shot basis, yet they are relatively simple in physical construction and use. Certain problems are encountered, however, in adapting the units to use in commercially available apparatus. The apparatus includes a pair of pressure-applying rollers designed for initiating processing of the film unit, and it is between these rollers that the dark slide must be removed. The problem results from the pressure of the rollers, which presents undesireable resistance to removal of the dark slide. Additionally, unless the film unit is restrained in the apparatus, it will shift out of its intended exposure position when the dark slide is removed. At the same time, however, any restraint shouldn't interfere with the proper function of the rollers during processing with the removal of the film unit from the apparatus after the film unit is exposed.

It is to these and related problems that the present invention is directed and for which it provides improvements having significant advantages not available from the teaching of the prior art.

SUMMARY OF THE INVENTION

In accordance with the present invention, an instant-processing film unit, having an internal dark slide, is provided with detent shims which, when the film unit is used with commercially available exposure and processing apparatus, facilitate the removal of the dark slide while restraining the rest of the film unit against movement.

The film unit includes a photosensitive element for recording a processable latent image, a cover sheet for confining a processing composition distributed over the element, a removeable dark slide positioned between the element and sheet to protect the photosensitive element from daylight fogging, and a leader for removing the film unit between the rollers and from the apparatus. The detent shims are carried by the leader and are spaced apart sufficiently to straddle the dark slide. The shims have a caliper that is greater than the thickness of the dark slide and are positioned to receive one of the pressure rollers when the film unit is in proper position for exposure in the apparatus. They space the rollers to provide clearance for removal of the dark slide, and restrain the rest of the film unit from shifting when the dark slide is removed, yet they offer minimal resistance to removal of the film unit after its exposure and don't interfere with the function of the pressure rollers during processing.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENT

Figure 1:
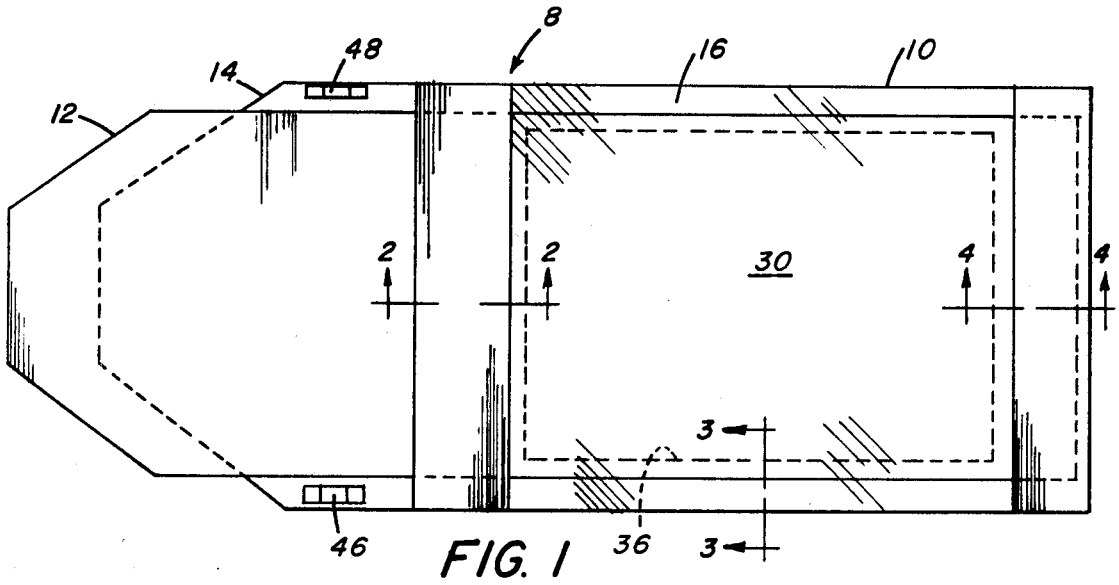
FIG. 1 is a plan view of a film unit in accordance with the preferred embodiment of the invention depicting its general features including the picture unit, dark slide, and lifters.
Figure 2:
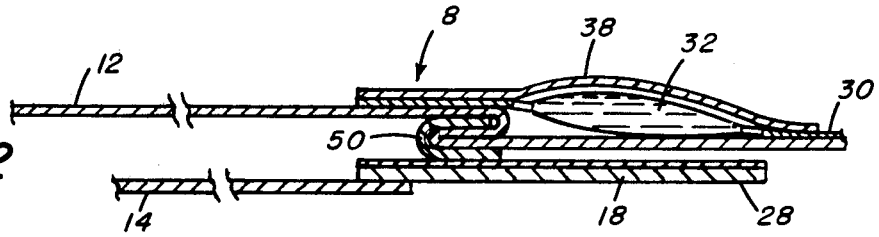
FIGS. 2–4 are cross-sectional views of the film unit of FIG. 1 taken as identified in FIG. 1 and illustrating internal features at the ends and edges of the film unit.
Figure 3:
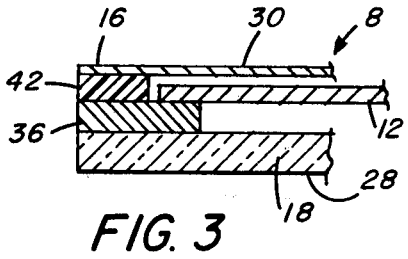
Figure 4:
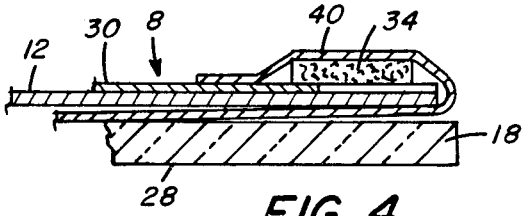
Figure 5:
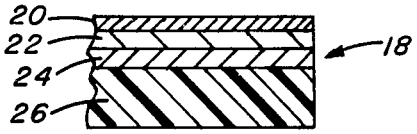
FIG. 5 is a cross-sectional view of the photosensitive element illustrating certain of its layers.
Figure 6:
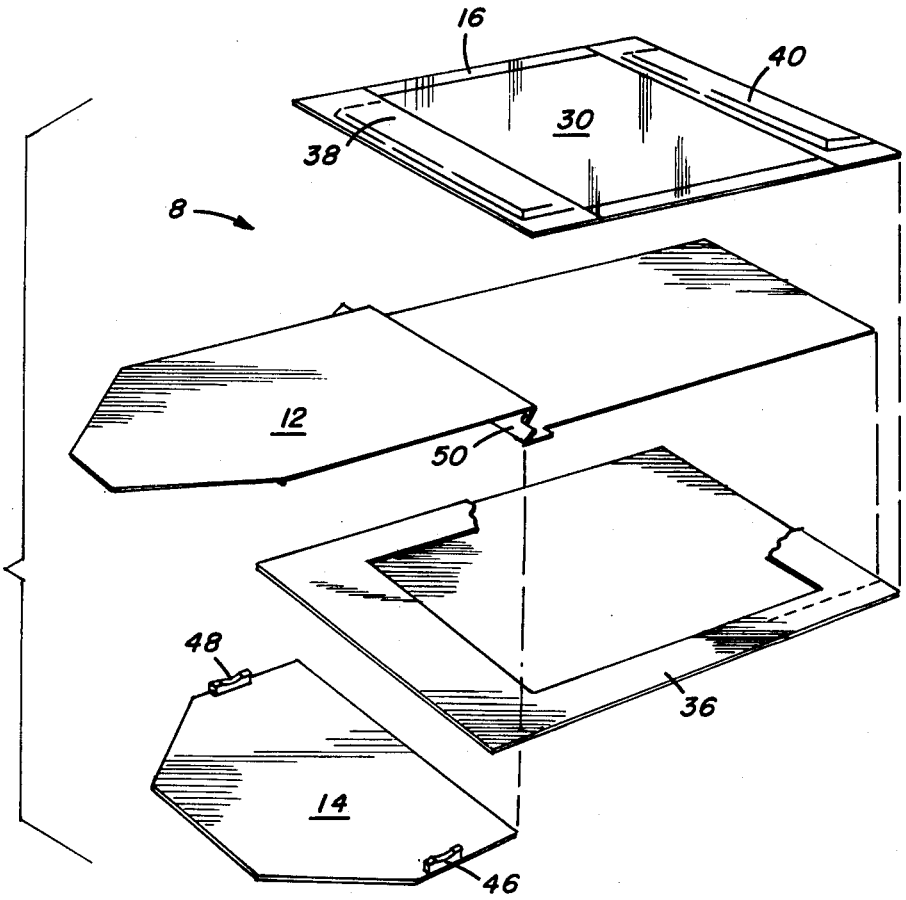
FIG. 6 is an exploded view of the film unit of FIG. 1.
Figure 7:
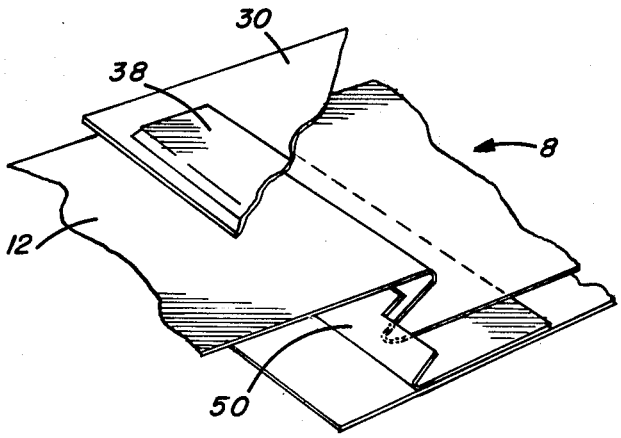
FIG. 7 is an enlarged partial view of a light seal between the dark slide and film unit at the leading end thereof.

Referring now to the drawings, and especially to FIGS. 1–6, a photographic film unit 8 is depicted in accordance with a preferred embodiment of the present invention as including a picture unit 10, dark slide 12 and leader arrangement 14.

The picture unit includes first and second sheets coupled along their lateral margins 16, as in the preregistered integral film unit described in the "Background of the Invention". One of the sheets is a photosensitive element 18 including a plurality of light-sensitive layers 20, (FIG. 5) an opaque layer 22 and an image receiving layer 24 carried on a dimensionally stable transparent support 26. These and additional respective layers of the photosensitive element are known in the prior art and will not be described in detail. It should be recognized, however, that the radiation sensitive layers are suitable for recording a latent image that is processable to establish a visibly perceivable image. The opaque layer shields the sensitive layers from actinic or other radiation striking one face 28 of the picture unit, and the image receiving layer is adapted to receive the final image, which diffuses thereto through the opaque layer during processing.

The other of the sheets is a transparent cover sheet 30 which serves several functions including confinement of the processing composition to facilitate its distribution during processing. As will become more apparent from the following description, the cover sheet also confines the dark slide in proper position for its intended purpose in accordance with the present invention.

Reservoir means, including a chemical pod or pouch 32 (FIG. 2) and trap 34 (FIG. 4) are disposed at the leading and trailing end sections of the picture unit, respectively. The pouch is provided for supplying the processing composition for distribution between the photosensitive element and process sheet. The trap collects any excess of the composition from between the element and sheet.

The final print when it is formed in the image receiving layer, should have precisely established edges. For this purpose, an opaque mask 36 extends along the end sections and lateral margins of the picture unit to create an image frame which defines the perimeter of the final picture area. Preferably, the mask is of the internal type adhered to the photosensitive element facing the cover sheet. The mask also may be used for covering the pod and trap, such as by cutting a piece 38 for placement over the pod and by folding another piece 40 around the trap and cover sheet. In such case, the mask helps block light from entering between the sheets at the leading and trailing ends of the picture unit.

On top of the mask, opaque side rails 42 (FIG. 3) of known caliper are provided for spacing the mask and cover sheet to receive the dark slide. It is through the side rails and the mask that the cover sheet is secured with appropriate adhesives to the photosensitive element. The combined mask and side rails also prevent light from entering between the sheets at the lateral margins of the picture unit.

The leader arrangement includes a flexible but somewhat stiff leader 44 overlapped with and attached to the leading end of the photosensitive element to facilitate handling of the film unit in cooperating apparatus as described more fully hereinafter. Saddle detents or shims 46 and 48 are provided at the lateral edges of the leader for similar purposes.

The internal dark slide 12 is positioned between the photosensitive element and cover sheet and cooperates with the opaque layer on the opposite side of the radiation sensitive layers to encase the sensitive layers and shield them from premature exposure. Thus, a single film unit can be handled in daylight without fogging. The dark slide has a length which is sufficient to extend from, beginning at the trailing end section of the picture unit, to beyond the leader where it will be natural to grasp the dark slide rather than the leader whenever the dark slide is present. The dark slide covers the entire image frame and extends therebeyond to overlap the mask around the entire perimeter of the final-image area. Moreover, the caliper of the dark slide is chosen so it will be confined and occupy the space between the mask and the cover sheet. It should not be so thick that its interference with the other elements causes undesirable frictional resistance nor so thin that it separates from the mask permitting light to reach and fog the photosensitive element.

A light seal including a flexible strip of opaque material 50 is provided at the leading end of the film unit. The strip is adhered to the photosensitive element, or actually to a mask on the element, and is interleaved with or folded into the dark slide so that pulling on the slide will straighten and release the strip from the dark slide. The width of the strip is selected to match the width of the photosensitive element and provide an adequate light seal.

Figure 8:
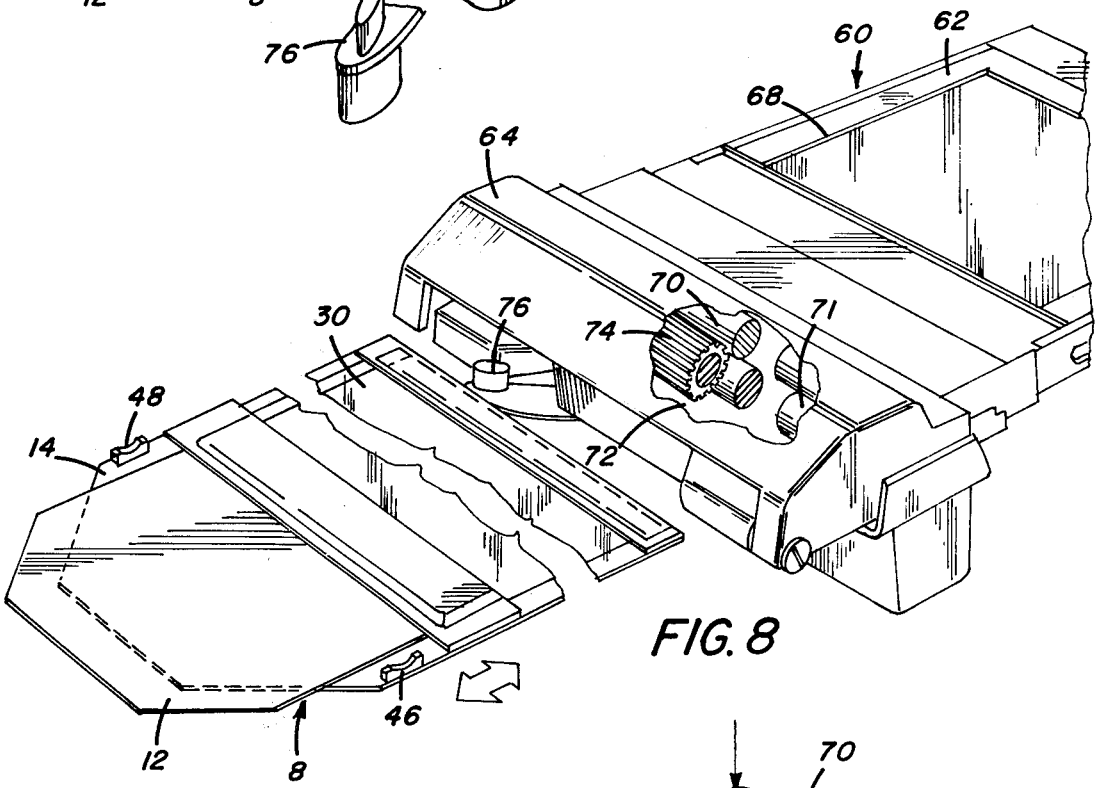
FIG. 8 is a perspective view of known apparatus in which the film unit of FIG. 1 is suitable for use.

The apparatus with which the film unit is adapted to be used is most clearly shown in FIG. 8. The apparatus comprises a camera-back adapter 60 of a type available commercially, including a body portion 62, and a processing section 64. The body portion defines a cavity for receiving individual ones of the film units and an exposure aperture 68 through which film units in the cavity are adapted to be exposed. The processing section includes a pair of pressure applying members 70, 71 (FIGS. 8–10), and a passageway 72 under light blocking means 74. A latch 76 partially shown in FIGS. 8 and 9 is moveable from an open or loading position (FIG. 8) where the pressure applying members are spaced-apart, and a closed or processing position (FIG. 9), where the members are urged together for initiating processing.

Figure 9:
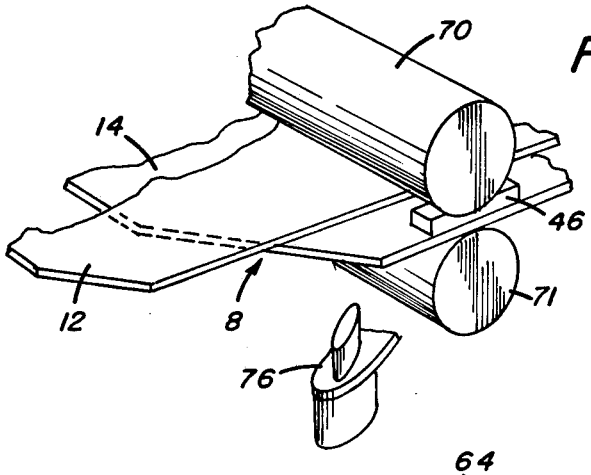
FIGS. 9 and 10 are partial views of the film unit of FIG. 1 and the apparatus of FIG. 8 depicting the detent lifters in operative position supporting the pressure rolls.
Figure 10:
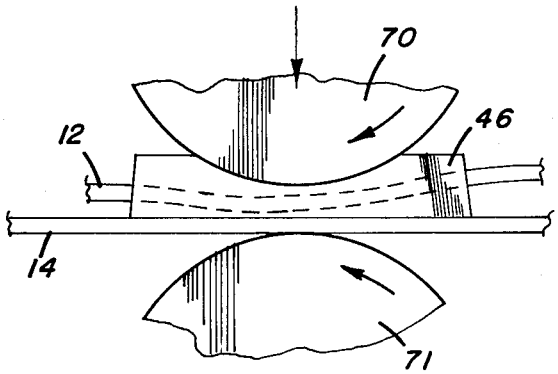

Referring now more specifically to FIGS. 8–10, the saddle detents or shims 46 are provided at opposite margins of the leader where they straddle the dark slide. The shims are located relative to the rest of the film unit so they will be between the pressure rollers when the film unit is properly positioned in the apparatus.

As illustrated, the shims are made of relatively hard plastic and are dish shaped where they engage and support the pressure rollers. This shape increases the force that must be exerted on the film unit to pull the shim from under the roller, and is considered preferrable when the shims are relatively incompressible. With more compressible materials, the concavity can be reduced or eliminated, so long as the force required to displace the shims from under the roller is greater than the frictional force required to remove the dark slide from between the photosensitive element and cover sheet.

As depicted in FIG. 10, the shims have a caliper which is greater than the thickness of the dark slide.

Figure 11:
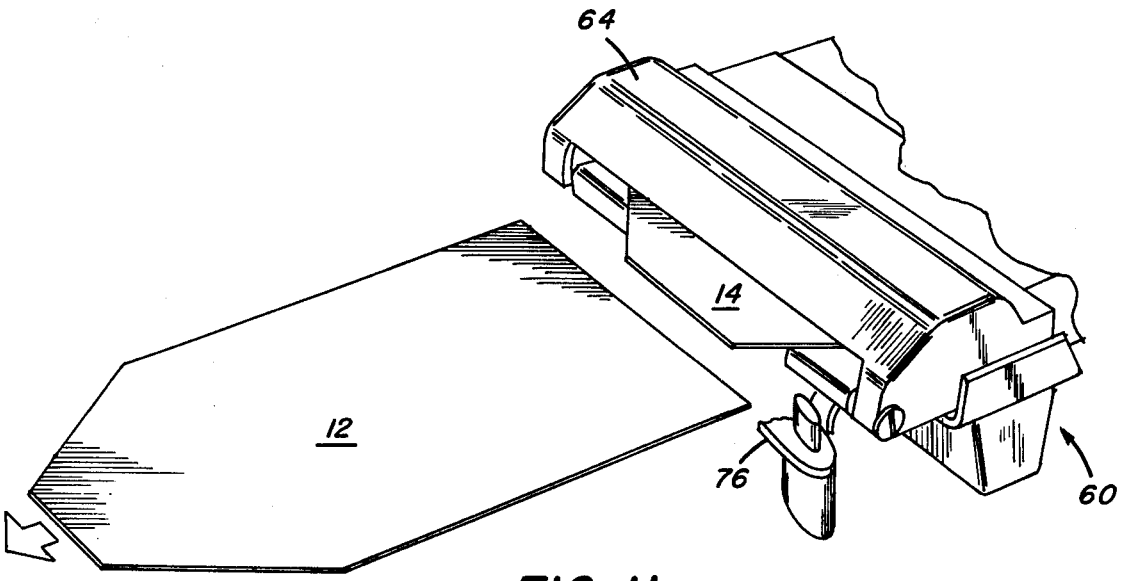
FIGS. 11–12 are partial perspective and front elevational views depicting the method of operation of the film unit of FIG. 1 in the apparatus of FIG. 8.
Figure 12:
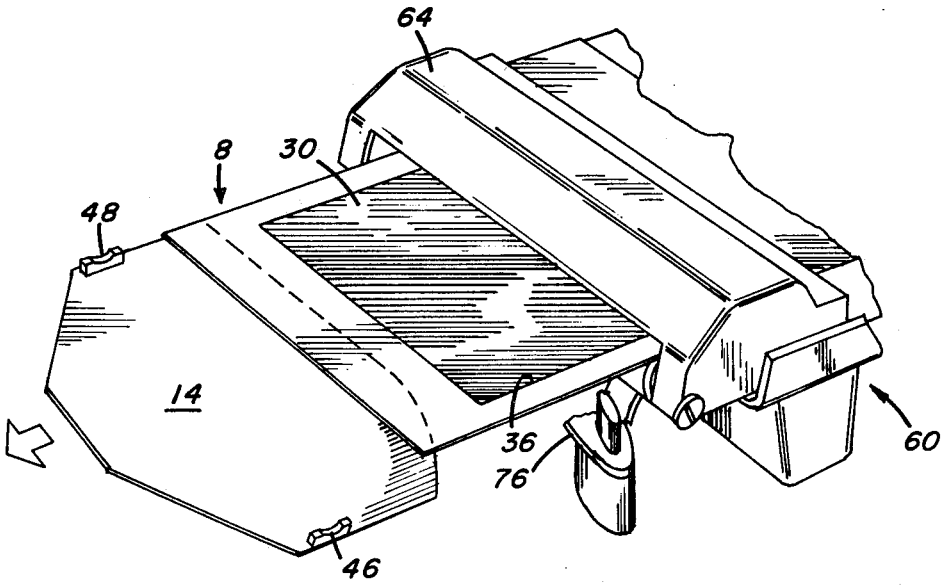

In operation, and referring first to FIG. 9, the latch 76 is moved to the open position, and the film unit is inserted through passageway 72 between the pressure applying members and into the cavity behind aperture 68. Suitable means, not shown, support the film unit in a substantially flat condition suitable for exposure. The latch 76 is closed and releases the pressure members which drop onto saddle detents 46 and 48 to hold the film unit in its proper operative position. The detents also support the pressure members 70, 71 and provide clearance for removal of the dark slide. The dark slide is then removed by grasping its leading end and pulling the slide (FIG. 11) entirely from the film unit and apparatus. This uncovers the photosensitive element and its light-sensitive layers for exposure. After exposure of the film unit, leader 44, uncovered by removal of the dark slide, is pulled to initiate processing and remove the film unit from the apparatus (FIG. 12). This distributes the processing composition from the pod between the photosensitive element and cover sheet. Assuming the composition includes an opacifier, as is common in integral film units, distribution of the composition establishes another opaque layer which cooperates with the first opaque layer 22 to shield the film unit from further exposure and permit daylight processing. During processing image-wise distributions of dyes diffuse through the first opaque layer 22, to the image-receiving layer 24, where the transferred image is visible from face 28 of the picture unit. Finally, if desired, the leader can be stripped from the picture unit which then becomes the final print.

Although the invention has been described with particular reference to a preferred embodiment thereof, it will be readily understood that variations and modifications can be effected within the spirit and scope of the invention as described hereinabove and as defined in the appended claims.

I claim:

1. An instant-processing film unit for use in processing apparatus, the apparatus having means for locating the film unit in an exposure position and a pair of pressure members for initiating processing of the film unit, said film unit comprising:

first and second sheets each having lateral margins, one of said sheets including a photosensitive layer for recording a processible latent image and an opaque layer for shielding one face of said photosensitive layer from fogging, the other of said sheets comprising a transparent cover;

means for coupling said sheets together, along their lateral margins, superposed with said photosensitive layer between said opaque layer and said transparent cover;

means for supplying processing fluid to said photosensitive layer to process the latent image;

a leader for removing said film unit from the apparatus between the pressure members;

a dark slide removable positioned between said sheets for shielding said photosensitive element from light passing through said transparent cover, said dark slide having a leading end section extending from between said sheets and superposed with said leader; and shim means carried by said leader and positioned on opposite sides of said dark slide both for: (a) supporting the pressure members apart to provide clearance for removing said dark slide between the pressure members; and (b) preventing shifting of said photosensitive element when said dark slide is so removed.

2. An instant-processing film unit for use in exposure and processing apparatus, the apparatus having means for locating the film unit in a position for exposure and a pair of pressure rollers for initiating processing of the film unit, said film unit comprising:

a photosensitive sheet-like element for recording a latent image processible to establish a final print, said element including an opaque layer and having a leading end section and lateral margins;

means for supplying a processing liquid to said photosensitive element to process the latent image;

a transparent sheet covering said photosensitive element and connected to said lateral margins;

a leader sheet coupled to one of said photosensitive element and cover sheet and extending away from said leading end section;

a dark slide removably positioned between said photosensitive element and said cover sheet for shielding said photosensitive element from light passing through said cover sheet, said dark slide extending from between said photosensitive element and said cover sheet adjacent said leader; and means carried by said leader and positioned to engage at least one of the pressure rollers for maintaining the rollers apart to provide clearance for removing said dark slide for the apparatus between the rollers, said last mentioned means further cooperating with the rollers for restraining the photosensitive element and cover sheet from movement with said dark slide.

* * * * *